US005913776A

United States Patent [19]

Compagnone

[11] Patent Number: 5,913,776

[45] Date of Patent: Jun. 22, 1999

[54] VARIABLE-SLOPE TIER DEVICES ALLOWING THE CONFIGURATION OF A SPORTS STADIUM OR AUDITORIUM TO BE CHANGED

[76] Inventor: Rocco Compagnone, 25, rue Saint Jacques, Paris 75005, France

[21] Appl. No.: 08/868,930

[22] Filed: Jun. 4, 1997

[30] Foreign Application Priority Data

Jun. 5, 1996 [FR] France ..... 96 06941

[51] Int. Cl.[6] ..... E04H 3/12

[52] U.S. Cl. ..... 52/10; 52/6; 52/9; 52/183; 52/67; 297/257

[58] Field of Search ..... 52/8, 9, 10, 6, 52/7, 183, 126.5, 126.6, 67; 108/145, 147.19; 297/257, 344.1, 344.12, 344.13, 344.18, 344.2

[56] References Cited

U.S. PATENT DOCUMENTS

| | | | |
|---|---|---|---|
| 1,517,774 | 12/1924 | Duprey | 52/10 |
| 2,740,165 | 4/1956 | Ward | 52/8 |
| 4,633,625 | 1/1987 | Dieban et al. | 52/6 X |
| 4,854,092 | 8/1989 | Chatenay Eepouse | 52/10 |
| 5,517,789 | 5/1996 | Sugiyama | 52/10 |

FOREIGN PATENT DOCUMENTS

| | | | |
|---|---|---|---|
| 0649952 | 4/1995 | European Pat. Off. . | |
| 2605037 | 4/1988 | France . | |
| 2687713 | 8/1993 | France | 52/9 |
| 2704585 | 11/1994 | France | 52/9 |
| 4212330 | 10/1993 | Germany | 52/8 |
| 1213590 | 3/1996 | Germany | 52/10 |
| 63-171561 | 8/1988 | Japan . | |
| WO 94/25706 | 11/1994 | WIPO . | |

OTHER PUBLICATIONS

"Telescopic Magic Telescopic Platform Seating Systems", Hussey Seating Co., brochure found in Sweet's General Building & Renovation Catalog File, 4 pages Mar. 1995.

"Elevating Floor Converts Night Club to Theater", Popular Mechanics, vol. 96, Issue 4, p. 133 Oct. 1951.

*Primary Examiner*—Carl D. Friedman
*Assistant Examiner*—Laura A. Callo
*Attorney, Agent, or Firm*—Fisher, Christen & Sabol

[57] ABSTRACT

Devices for changing the slope of rows of tiers, whose bearing structures are definitively or temporarily fast, by a single elevating operation. The devices include tiers whose bearing supports are constituted by first long columns and second short columns, which, by actuation of elevating motors are alternately brought in supporting position of the tiers, the first long columns in active supporting position generating a first, more accentuated slope profile for the tiers, the second short columns, brought in active position of the tiers generating a second less accentuated slope profile.

8 Claims, 16 Drawing Sheets

VARIABLE-SLOPE TIER DEVICES ALLOWING THE CONFIGURATION OF A SPORTS STADIUM OR AUDITORIUM TO BE CHANGED

FIELD OF THE INVENTION

The present invention relates to devices for changing the configuration of a multi-purpose auditorium or sports stadium, in order to adapt it rapidly to the specific needs of the cultural or sportive disciplines.

BACKGROUND OF THE INVENTION

The changes in configuration, which involve changes in the visibility curves and the variation of the sitting capacity of the hall in question, are conventionally obtained by adding or removing additionnal movable tier devices generally having only one slope, or by systems of elevator floors requiring the creation of a pit and whose surface, by definition segmented into rows, is incompatible with the nature of certain sports floors such as ice rinks or basketball floors.

Multi purpose halls of the prior art may be illustrated by the following Patents, or Patent applications: International Patent Application WO 94 25 706 A, in the name of the applicant, EP 0 649 952 A, JP 63 171 561 A, and FR 2 605 037 A.

In the devices belonging to the hereabove cited prior art, the servitudes of storage and handling additionnal rows of tiers for temporaty use, or the necessity of creating a technical pit are translated by high investment and working costs and prevent existing halls, designed for one activity, from being arranged so as to accommodate other forms of shows, likely to improve the commercial working thereof.

It is an object of the present invention to overcome these drawbacks.

SUMMARY OF THE INVENTION

To that end the present invention relates to a multi-stepped spectator seating device for multi-purpose auditorium or stadium, of the type comprising a plurality of parallel tiers, arranged in rows, the tiers being constituted by seat-supporting platforms, the tiers being adjustable in height, thus allowing the device to present more than one slope profile, wherein it further comprises:

a) first and second supporting columns for each of said tiers, the height of said columns decreasing from the uppermost tiers towards the lowermost, the first and second columns being adapted to be alternately put in position for supporting the corresponding tier, the first supporting columns being integral with the corresponding tier and, in the active position of said columns, resting on the floor and giving the rows of tiers a first slope profile, the second columns being independant of the corresponding tier and being of height shorter than the first columns of the same tier, b) elevating means adapted to raise the level of the second columns from a lower, inactive position towards an elevated, active position in which the head of each of said second columns comes in supporting position of the corresponding tier and raise the same, whereas the base of the first columns, which are thus placed in inactive position, no longer bears on the floor, the second columns in said active position determining a second, less accentuated, slope profile of the tiers.

It is understood that when the first and longer columns, for all the tiers of a same row, are in active supporting position, their bases rest on the floor and their heads support the corresponding tiers, each tier being integral with the head of the corresponding first columns. In this first position of the tiers, then resting on the first longer columns, the second and shorter columns are in inactive lower position, and the slope profile of the tiers is the most accentuated.

Alternately, when the elevating means are actuated, they raise all the second (shorter) columns belonging to all the tiers of a same row, from their lower inactive position, up to a position in which the heads of said second columns come in contact with the corresponding tier and raise successively all the tiers; the said tiers in a same row of tiers, under the supporting and elevating action of the second columns are placed in a second position where the slope profile is less accentuated.

In accordance with particular embodiments:

The first and second columns of different lengths which constitute alternative support for each tier, may be sliding within each other in a telescopic manner; the inner column will constitute the first and longer column, and the outer column will constitute the second and shorter column All the first and long columns connected to the tiers belonging to a same row will have dimensions decreasing from the upper tier towards the lowest tier and defined in order to give the tiers that they support a first specific slope, for example the one compatible with the visibility curves of a configuration around an ice rink.

All the second and short columns have in the same way decreasing dimensions defined in order to give the tiers that they are intended to support a second slope different from the preceding one and more particularly this second slope profile is less accentuated than the first slope; this second slope is for example the one compatible with the visibility curves of a configuration around a basketball floor.

All the second and short columns may advantageously be connected to one another so as to create a rigid structure capable of being displaced vertically or horizontally as a single unit by the elevating means. The connection means adapted to connect the second columns together may be either permanent and in a fixed position, or may be of removable structure, for instance when the tiers and their supporting columns, in a same row, are horizontally retractable within each other.

All the first and second supporting columns, whose dimensions in plan and in volume are reduced compared with the area and volume occupied by all the tiers that they support, may advantageously be arranged so as leave a free space between the said columns and under the supported tiers to render exploitable the surface and the volume left free for storage functions, for example.

The vertical displacement necessary for the alternation of the slopes of the tiers may advantagoeusly be exploited to create an access beneath the tiers in order in particular to facilitate the functions of storage for instance of accessories or of additionnal movable tiers.

This same vertical displacement may also be used for activating or de-activating the positioning of certain safety barriers necessary for certain sports, for example sports on ice.

The second columns, according to a variant, may comprise overlap means in the form of abutments overlapping from one second column belonging to an upper tier above the second column belonging to an adjacent lower tier, so as to cause the second columns of the lower tier, when elevated under the action of elevating means to bear and raise the adjacent second columns belonging to the upper tier. Each elevation movement in a set of second columns belonging to a given tier inducing elevation of the adjacent set of second columns belonging to the upper tier.

The said first and second columns, may support straight or curved tiers.

BRIEF DESCRIPTION OF THE DRAWINGS

The invention will be more readily understood on reading the following description with reference to the accompanying drawings, in which.

Figure 7:
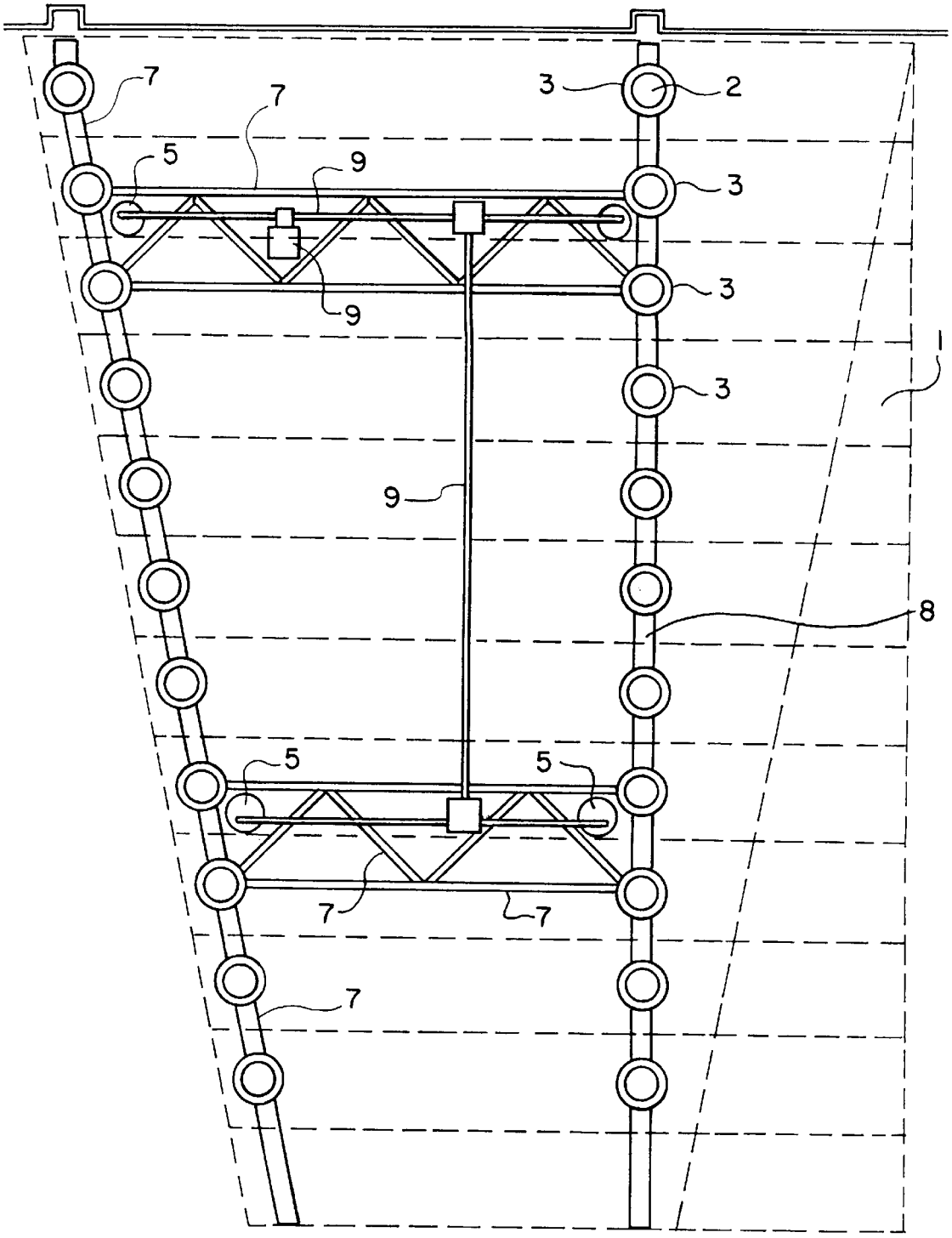
FIG. 7 shows in plan view a series of long and short sliding columns as well as the structure connecting the short columns and supporting known elevating systems. The tiers are shown here in rectangular or trapezoidal form.
Figure 8:
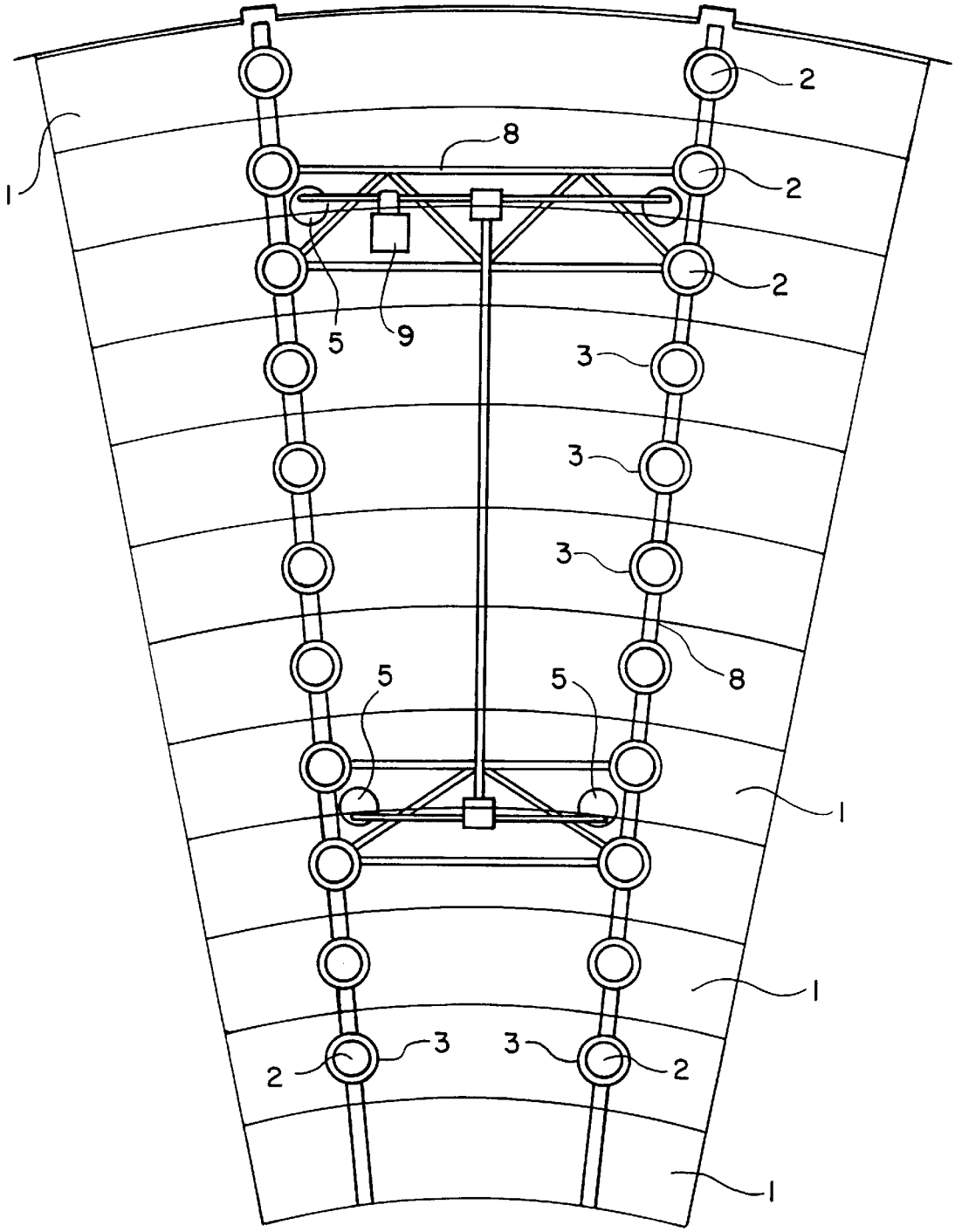
FIG. 8 shows the arrangements of FIG. 7, but with tiers in curved form.
Figure 9:
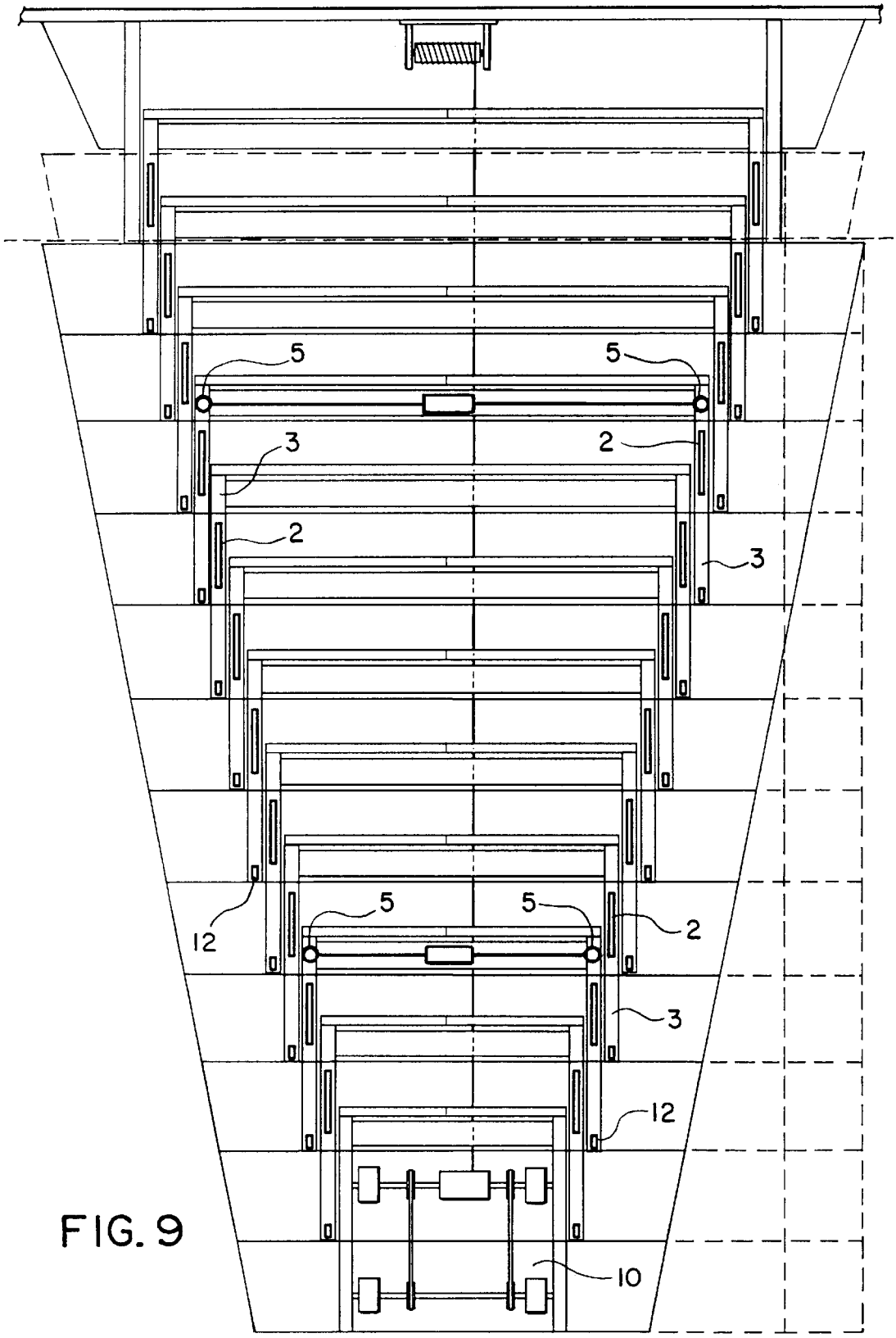

While FIGS. 1 to 8 relate to a first embodiment wherein the second columns belonging to the stepped tiers in a same row of tiers, are rigidly connected, for example through cross pieces or beams, FIGS. 9 and following relate to a variant, in which the second columns are independent from one tier to the other and accordingly the successive and stepped tiers and their supporting first and second columns are movable from a retracted storage position substantially in a same rear plane, towards an active extended position, the tiers and supporting columns in a same row of tiers forming a horizontally telescopic system.

FIG. 9 shows in plan view a series of telescopic tiers in extended position according to the said variant.

Figure 10:
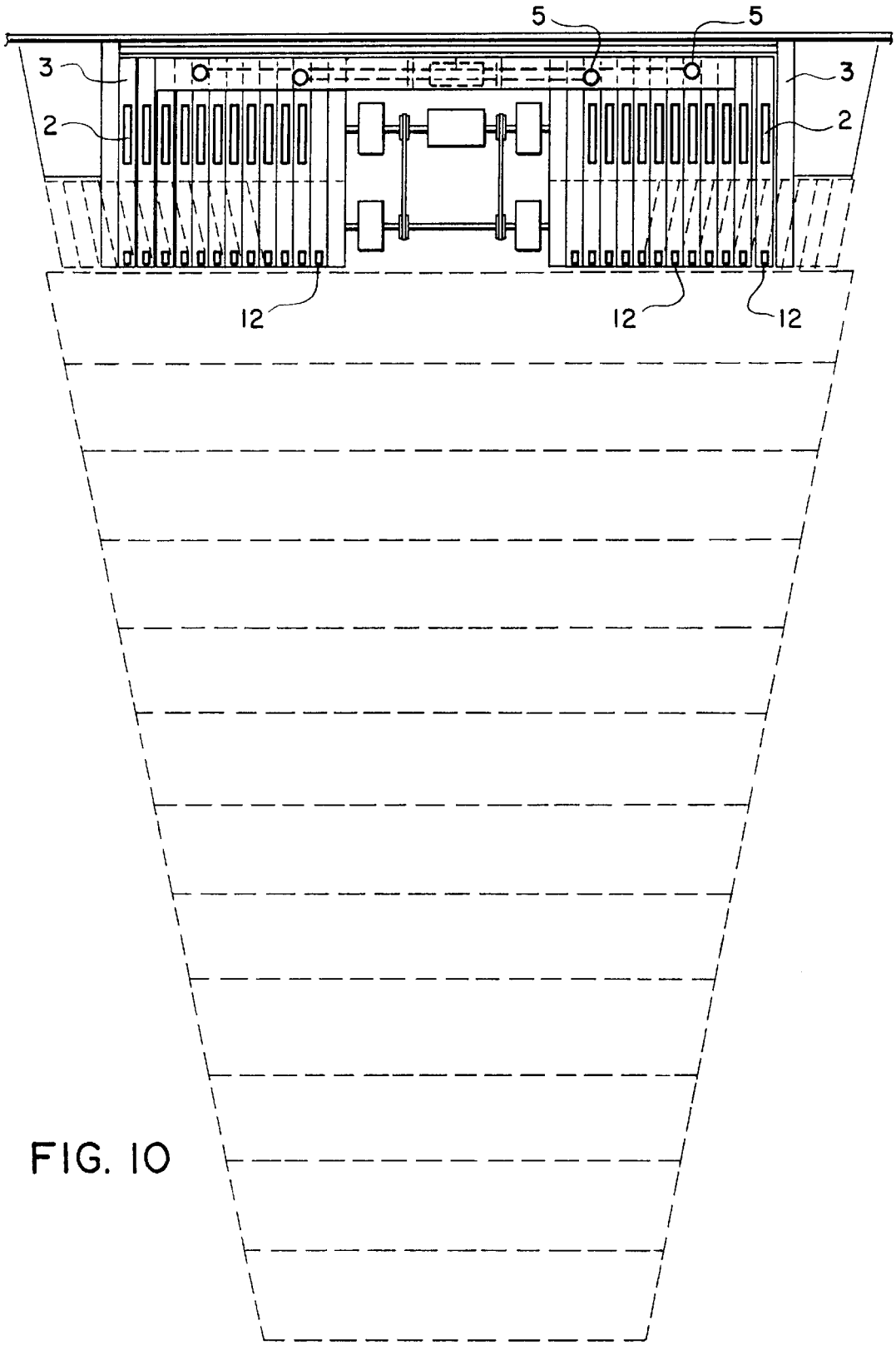

FIG. 10 shows in plan view the telescopic tiers of FIG. 9 in their retracted position.

Figure 11:
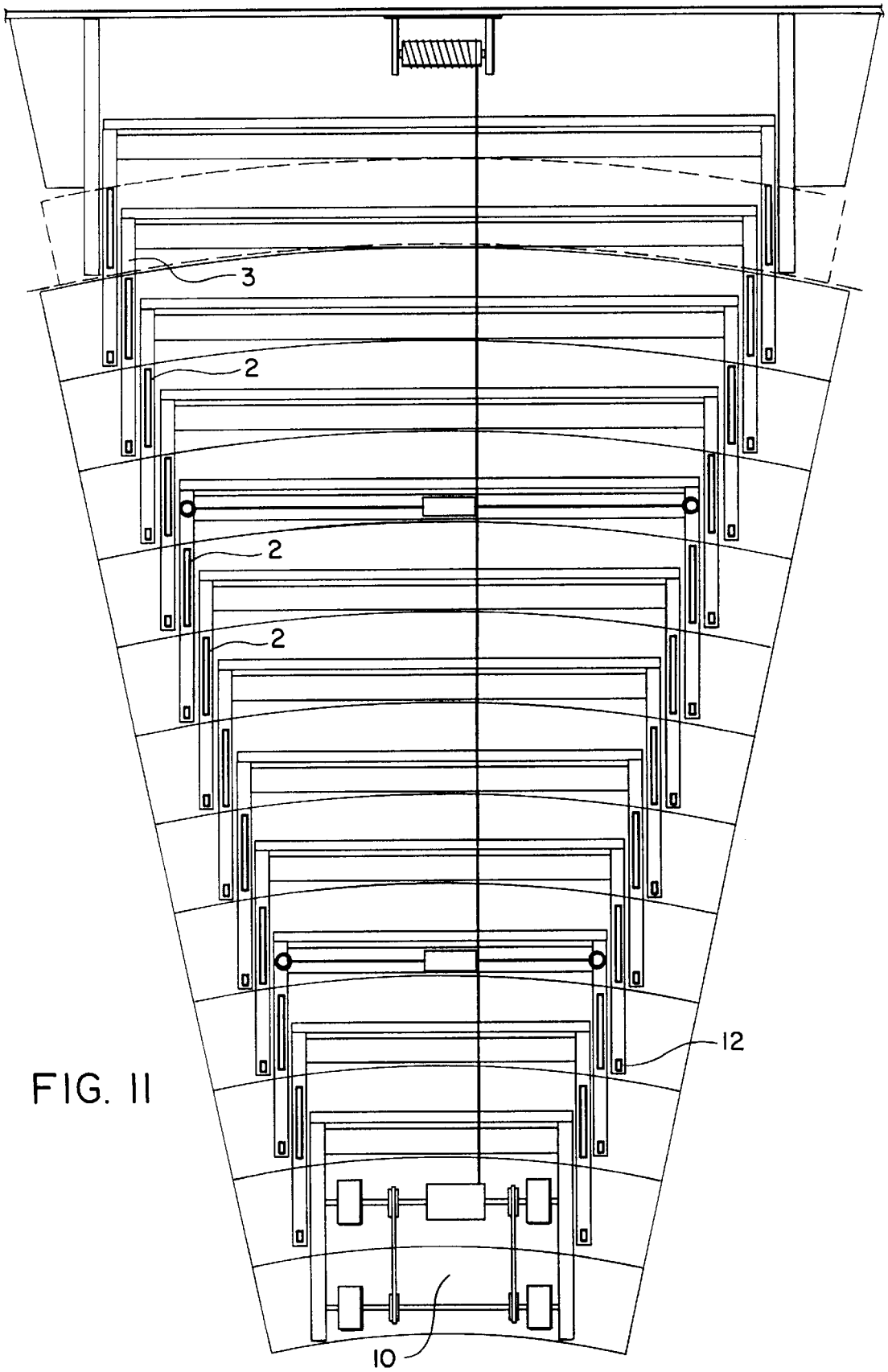

FIG. 11 shows in plan view telescopic tiers of curved form in extended position.

Figure 12:
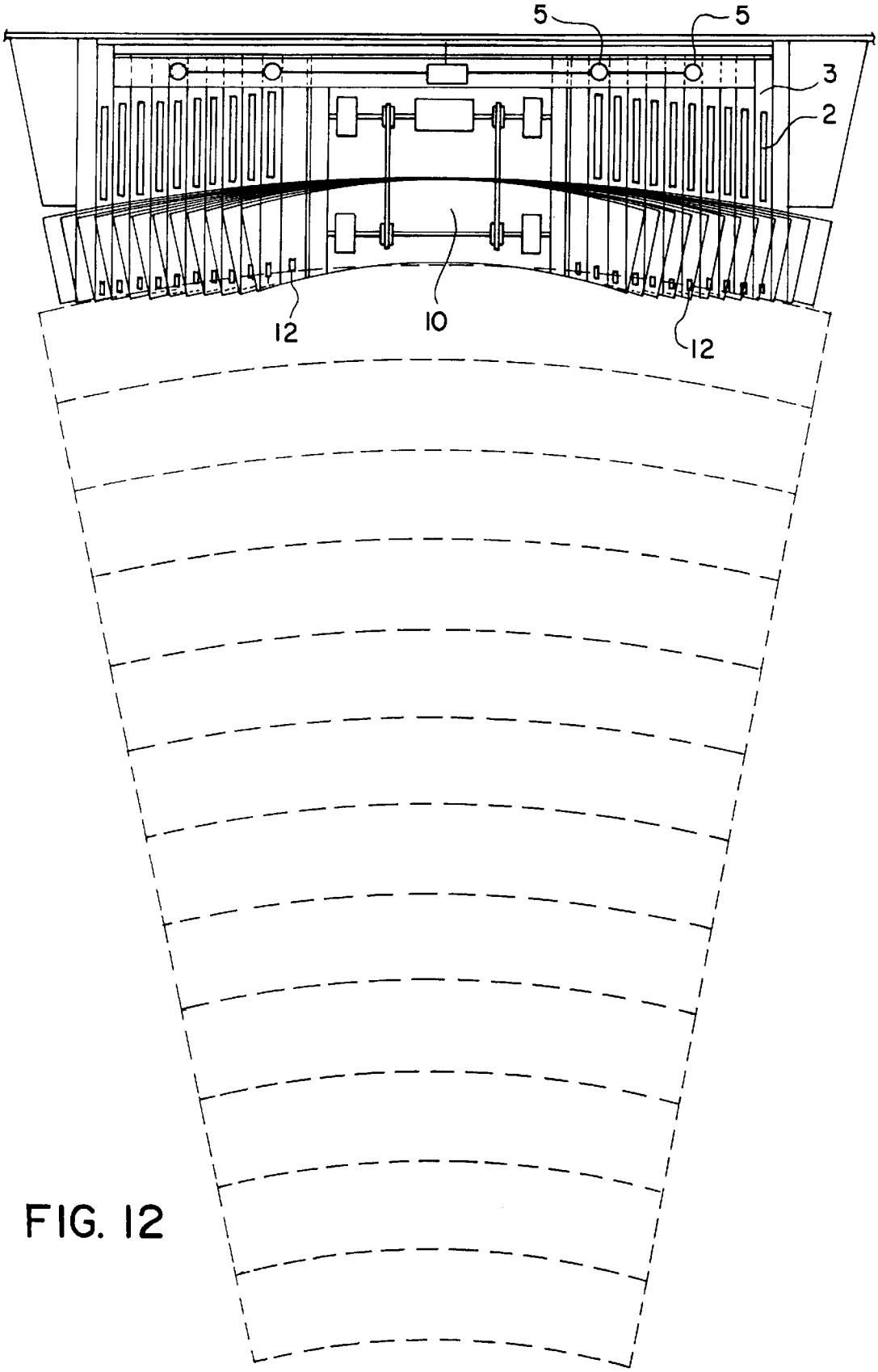

FIG. 12 shows in plan view the telescopic tiers of curved form in retracted position.

Figure 13:
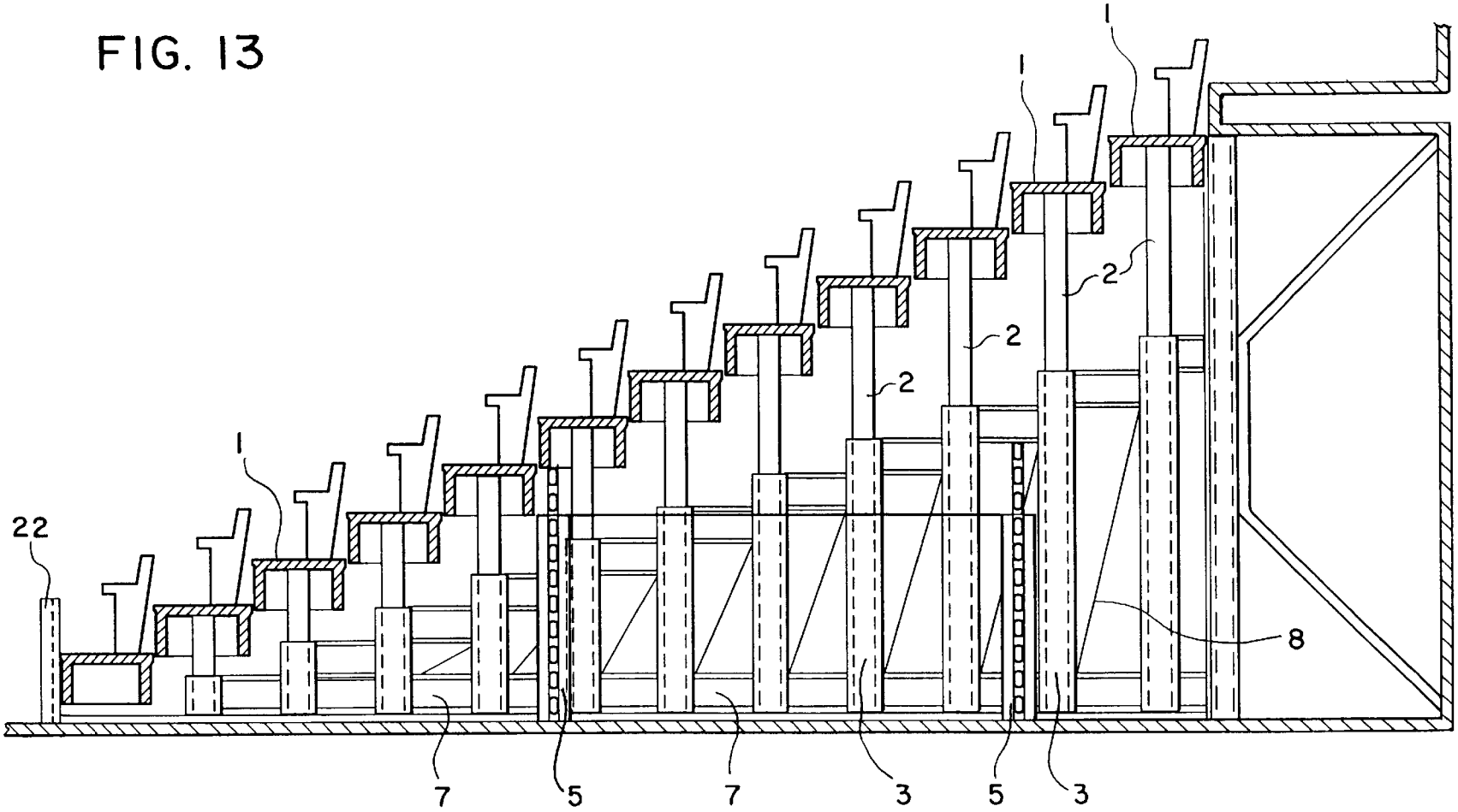

FIG. 13 shows in section a row of tiers in their position of most accentuated slope, the tiers being then supported by the first long columns.

Figure 14:
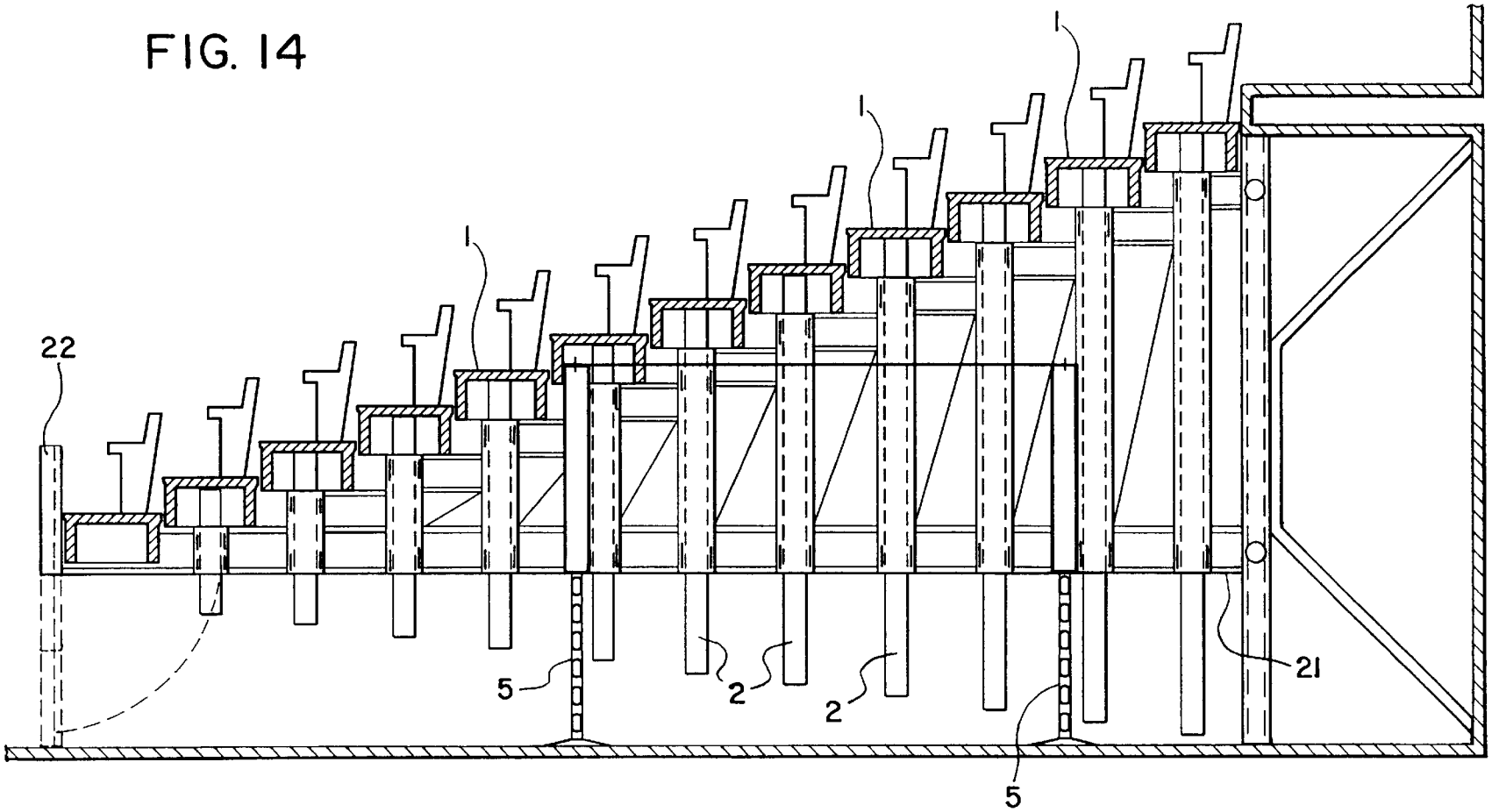

FIG. 14 shows in section the same tiers of FIG. 13, in their position of less accentuated slope, being supported by the second and short columns in active and elevated position after actuation of elevating means associated therewith.

Figure 15:
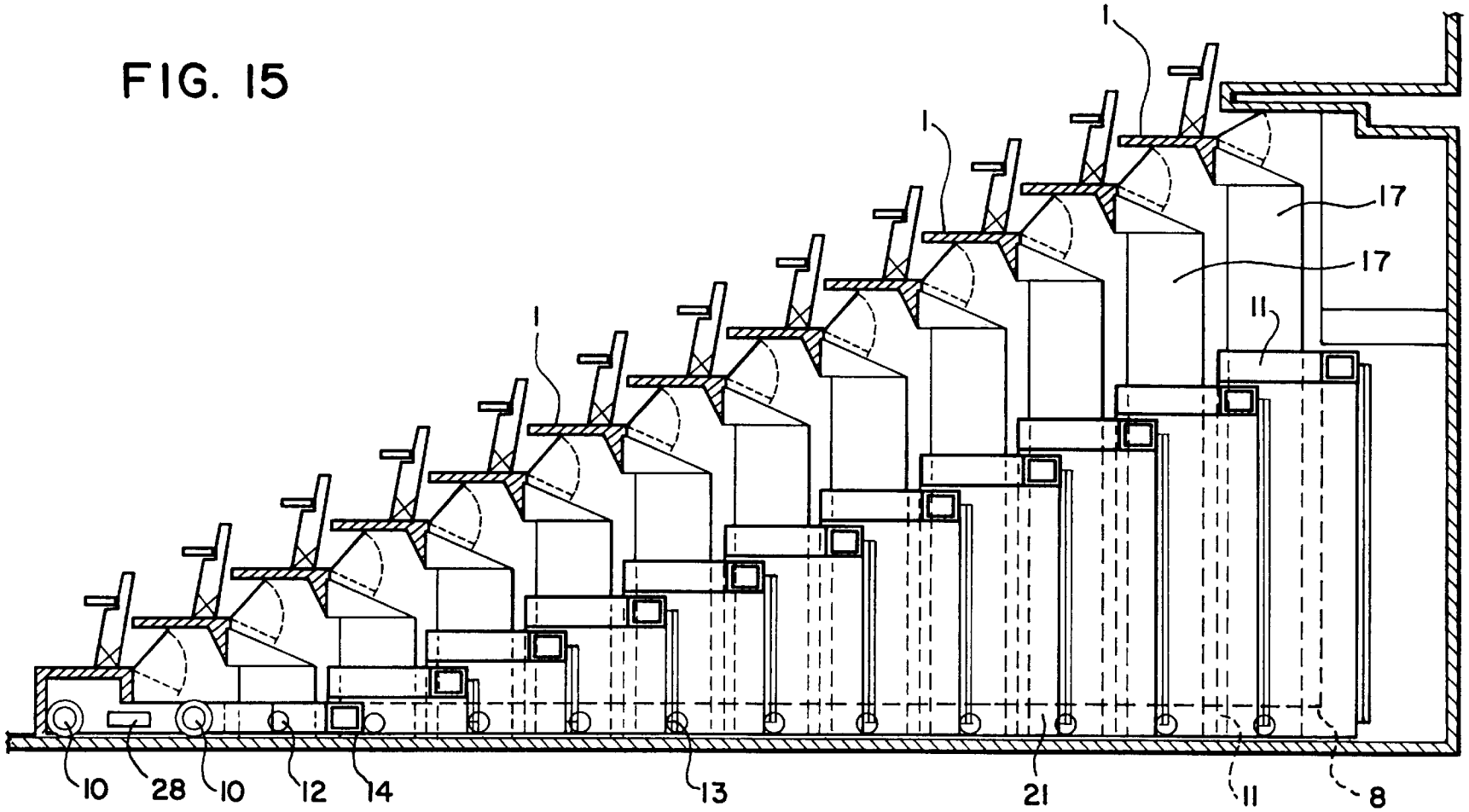
Figure 16:
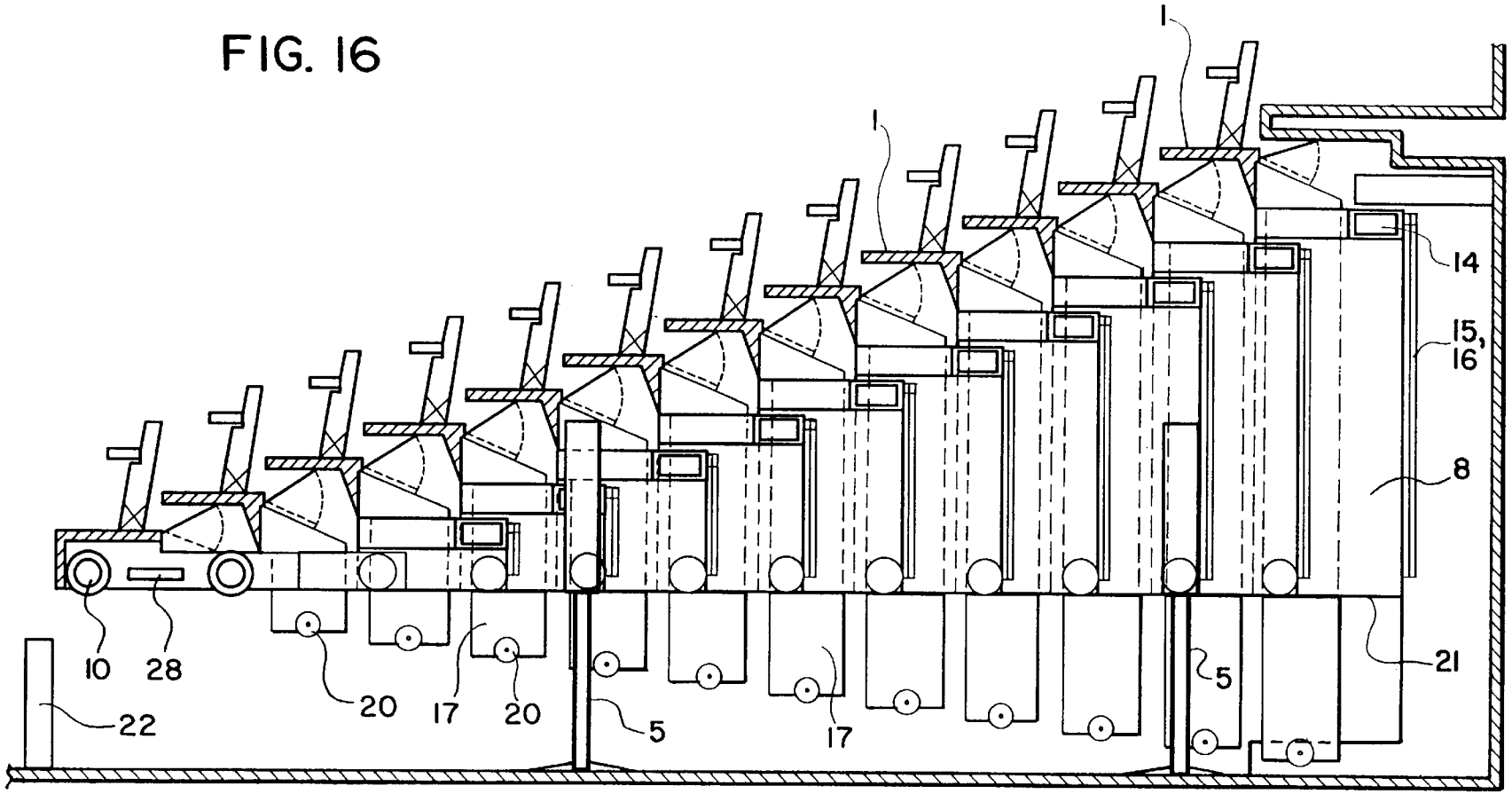

FIG. 15 shows in section telescopic tiers in their extended position and resting on the first columns, corresponding to the first slope profile FIG. 16 shows in section the tiers of FIG. 15, in their second slope profile, the tiers resting on the second column in elevated and active position.

Figure 17:
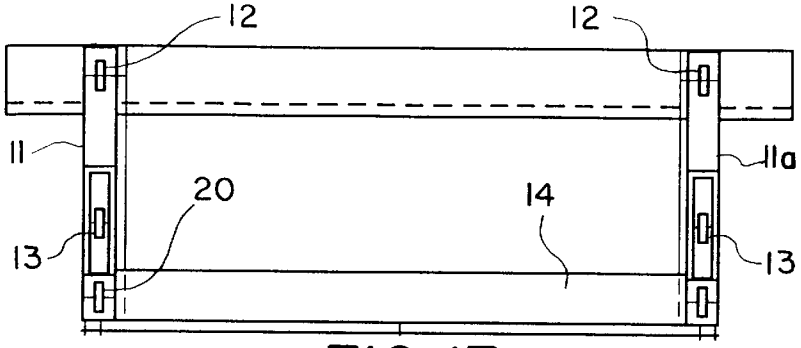

FIG. 17 shows in plan view a pair of first and long columns and of second and short columns, forming an assembly likely , when raised by the elevating means, to come in contact with the adjacent assembly belonging to the upper tier and to raise it.

Figure 18:
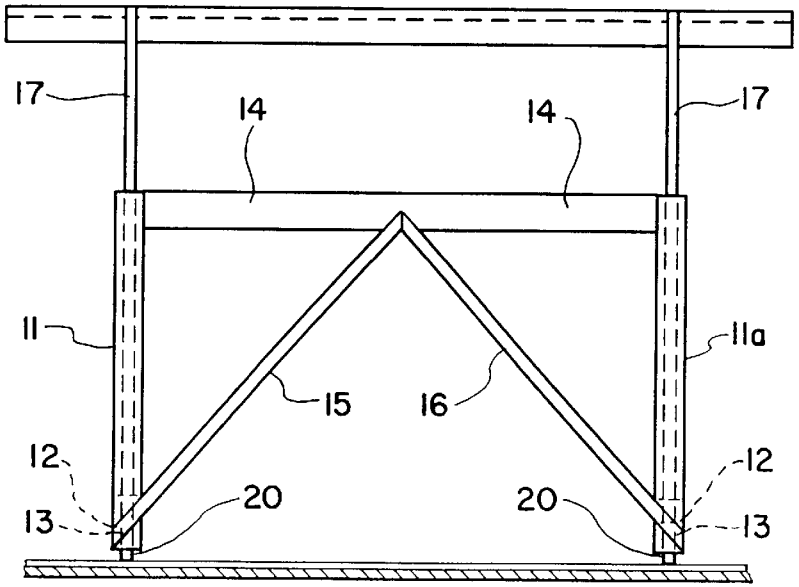

FIG. 18 shows in elevation the rear of the assembly of FIG. 17.

Figure 19:
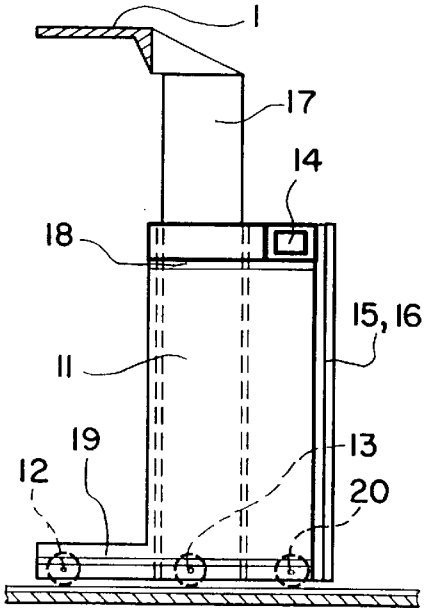

FIG. 19 shows in side view the assembly of FIGS. 17 and 18.

Figure 20:
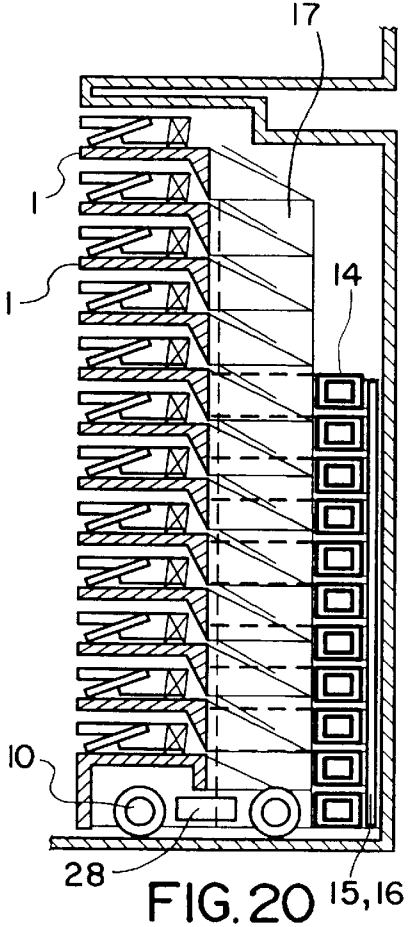

FIG. 20 shows in section a row of horizontally retractable tiers of variable slope of FIGS. 15 and 16, in their retracted position.

Figure 21:
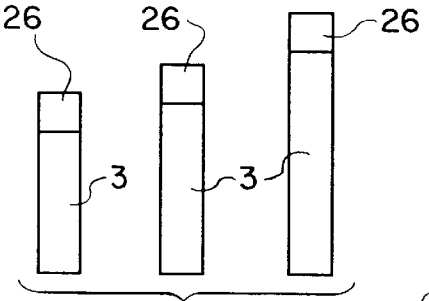

FIG. 21 shows jacks on the shorter columns (3).

DESCRIPTION OF PREFERRED EMBODIMENTS

Referring now to the FIGS. 1–8 of the drawings, the devices according to the invention comprise at least one tier (1) of which the bearing supports are constituted by two types of columns, i.e. a pair of first long columns (2), and a pair of second and short columns (3), able to support and adjust the position of the tier (1) in relation to the floor (4) alternately either directly in the case of the first and long columns (2) or via known elevating means (5) in the case of the second and short columns.

The second and short columns may be connected together by crosspieces (7) so as to constitute a rigid assembly (8) capable of being elevated by known elevation means (5) moved by a known kinematic chain and gear motors (9).

Figure 1:
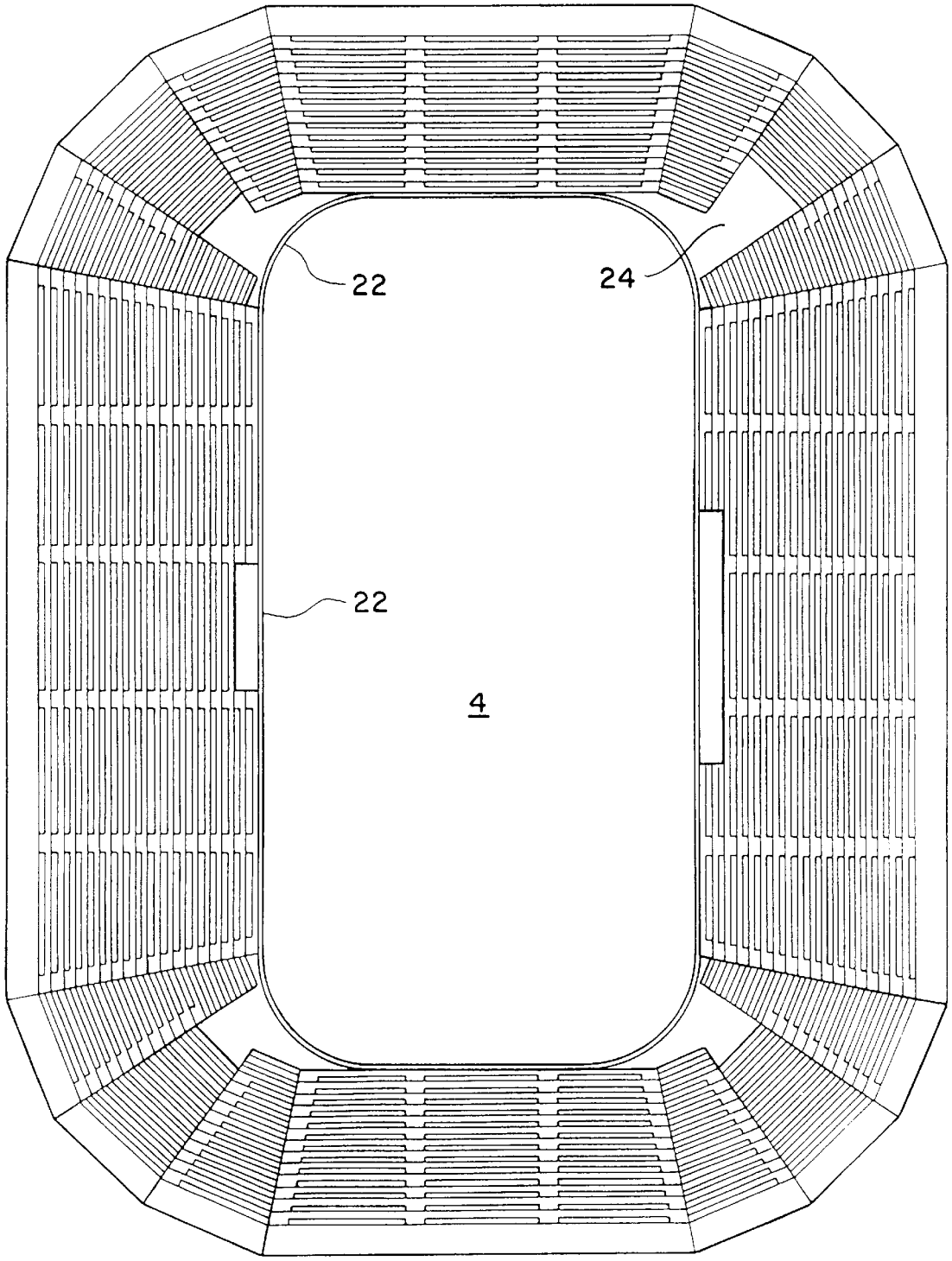
FIG. 1 shows a plan view of a configuration of a stadium intended for sports on ice.
Figure 2:
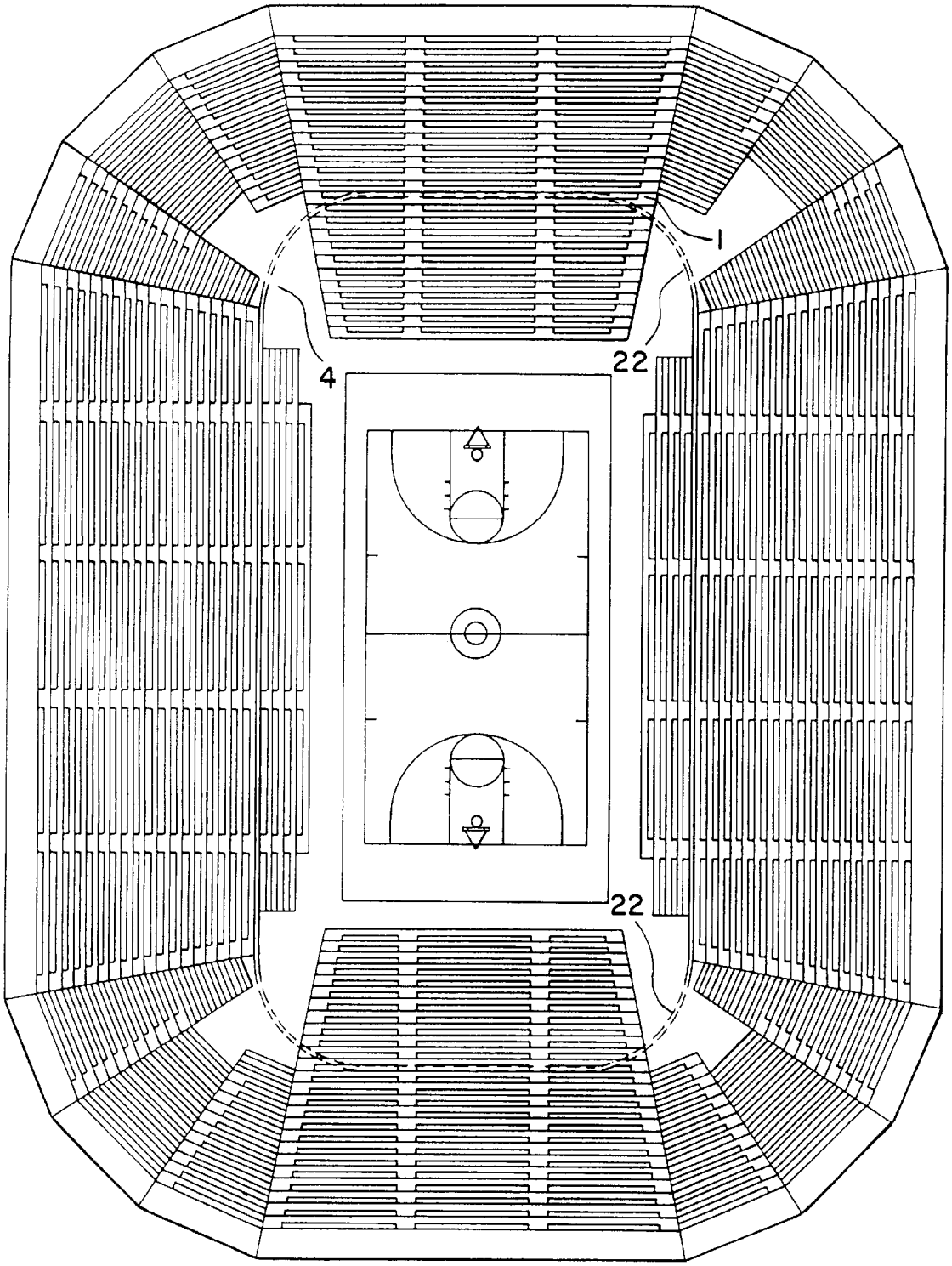
FIG. 2 shows this same stadium in its configuration intended for a ball game.
Figure 3:
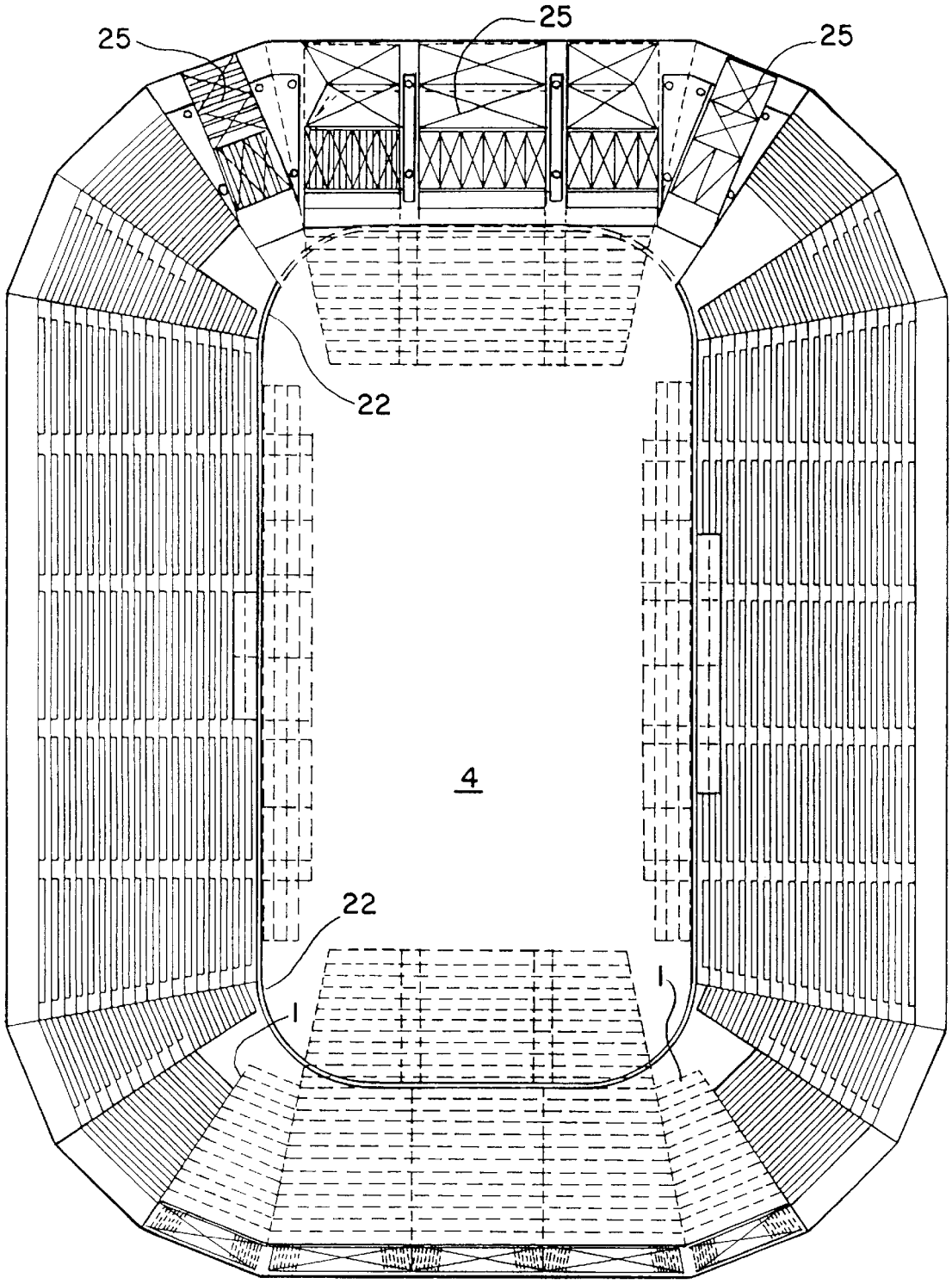
FIG. 3 shows in plan view, in dotted lines, the elements of this stadium which must be moved or modified to pass from the configuration of FIG. 1 to that of FIG. 2, and in solid lines the arrangement of said elements.
Figure 4:
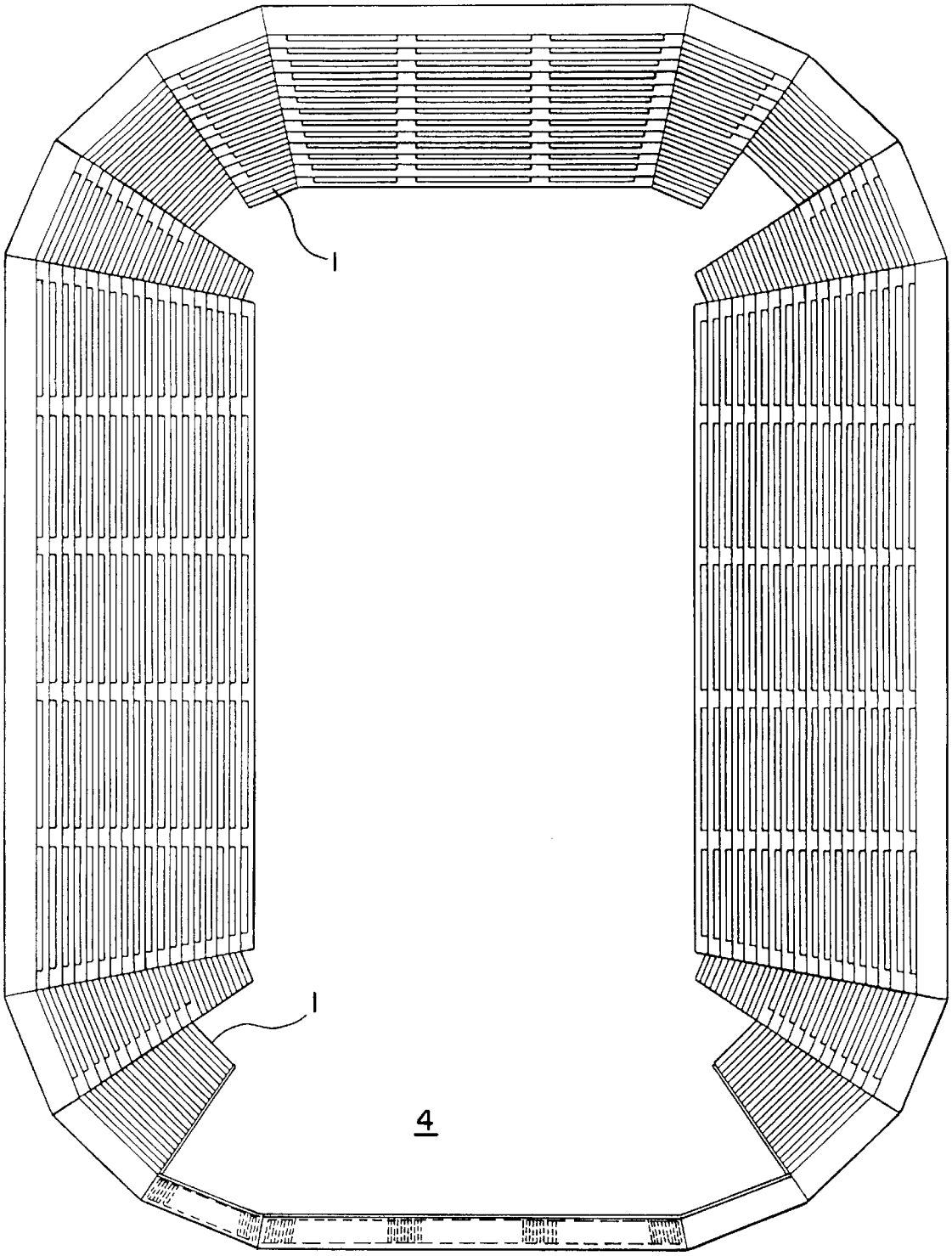
FIG. 4 shows in plan view the configuration of this same stadium freed of all the displaceable elements which may accommodate activities different from the two configurations cited by way of example.
Figure 5:
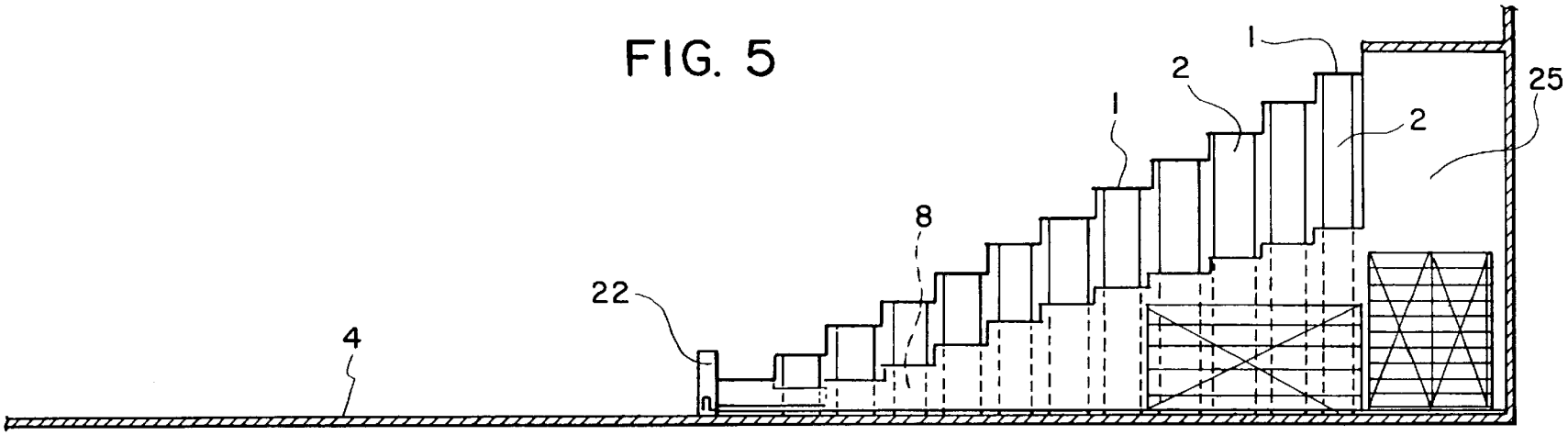
FIG. 5 shows in section the elements stored underneath the tiers, which themselves are shown at their greatest slope.
Figure 6:
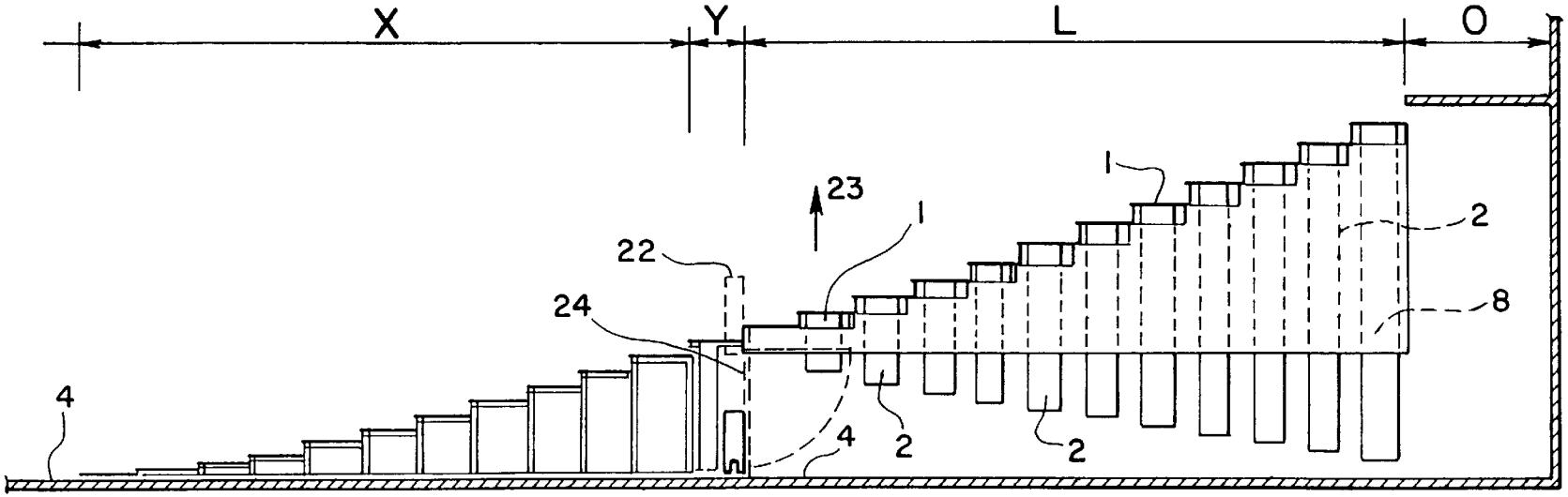
FIG. 6 shows in section these same elements in opened-out position, the tiers being shown at their smallest slope.

Numeral 23 represents an arrow which emphasizes the direction of the (vertical) movement of the tiers and seats when displaced upwardly. Numeral 24 as shown in FIG. 1 is any one of the gaps between two neighboring rows of tiers in each of the four corners of the arena; this empty space permits access from the center of the arena to the underneath of the tiers. The empty space underneath the tiers (likely to be used for storage) is shown in FIGS. 3 and 5 under numeral 25.

In the embodiment of FIGS. 7 and 9, the shape of the tiers (1) is rectangular or trapezoidal.

In the embodiment of FIGS. 8 and 11, the shape in plan view of the tiers (2) is curved.

The first and second columns are slidably mounted in each other, the first and longer column forming the inner column (2) having dimensions of section smaller that those of the second and shorter columns (3), which form the outer column, as shown in the plan view of FIG. 7.

Optionally, the heads of the second shorter columns (3) may be provided with additionnal and individual elevating means, such as jack 26 (shown in FIG. 21) for a more specific adjustment of the level of the tiers supported by the second columns, through said jack, so as to obtain a further slope profile adapted to specific needs.

It is emphasized that the difference of altitude, for the same tier, between the supporting head of the second shorter columns (3) and the head of the first longer columns (2), in the inactive position of the second columns, increases from the lowest tier towards the upper one (i.e. from left to right in FIG. 5); this difference being a consequence of the difference in the slope profile determined by the first columns and by the second columns when they are successively put in active position.

When the elevating means are actuated, the head of each second column (3) of the lowest tier comes first into contact with the said tier; and accordingly the weight of the said tier alone is added to the raising effort of the elevating means; and only after a moment the second columns of the adjacent tier arrives in its turn into contact and in supporting position for the said adjacent tier; so that the weight supported by the elevating means is increased, but progressively, without the need of an important force which would be needed if the tiers were to be raised all at the same time.

Furthermore whereas the upmost tier is not subjected to an important elevation movement, the lowest tier is raised and brought to a significant elevation in altitude (see FIGS. 5 and 6); by this vertical movement a passage under the raised lowest tier is freed and allows horizontal displacement on the floor (4) of additionnal rows of tiers, placed in front of the previously raised tiers (1), for temporary use.

According to the variant illustrated in FIGS. 9, 10, 11, 12, 16 and 20, the second shorter columns and the first longer columns are arranged so as to render the system of stepped tiers, retractable along a telescopically horizontal displacement on the floor, by actuation of pulling or pushing means acting on the lowest tier (reference 10, FIG. 9).

Still in accordance with this variant, the telescopically horizontally retractable system is characterized by the second, shorter and outer, column (11) having the shape of an I, and adapted to move over a horizontal floor by means of wheels (12) and (13). A pair of second ,shorter and outer columns (11) and **(11*a*) adapted to raise the same tier (1) are connected by an upper horizontal beam (14) and by two cross-bracing crosspieces (15) and (16). The said second columns are in the form of pipes of flattened rectangular section (11) and the dimension of the longer face of said pipes is greater than the width of the tier (1), mounted in overhang on the first and long column (17), so as to allow sufficient overlapping of one assembly constituted by one tier (1) and its corresponding supporting columns (11, 17) on the adjacent and lower one. The guiding of the horizontal translations of one I-shaped second column belonging to a tier, along the adjacent second column of the adjacent tier is facilitated and controlled by the guides means (18) and (19) placed at the top and bottom of each of said second columns, both opposite faces of two second columns facing each other comprising said guiding means, such as slide and rails cooperating from one face to the opposite one. It will be noted that the first, long column (17) is equipped with a wheel (20) allowing its horizontal displacements, driven by the tractor (28)**.

According to a variant (FIG. 19) the second columns are in the form of L, the low horizontal branch of which comprises slide and rails (19) likely to cause engagement of one branch of one second column with the branch of the adjacent second column, the mutually engaged horizontal branches of all the second columns on the same side of a row of tiers being thus connected and being likely to be raised as an integral beam 21 under actuation of the elevating means (5).

By way of non-limiting example, the devices according to the invention are particularly intended for sports stadiums in order to provide alternation between the configuration for sports on ice and for ball games on floors.

The combination of the various variants, permanent or telesopic, and straight and curved shapes, makes it possible to reduce the times taken to transform such a stadium or hall due to the possibility of using as close storage place the underneath of the tiers of variable slope, in their permanent position, and the raising of the protection barrier (22).

What is claimed is:

1. A multi-stepped spectator-seating device for multi-purpose auditorium or sports stadium and resting on the floor thereof, comprising:

(a) a plurality of tiers constituted by seat supporting platforms arranged in rows of parallel tiers, the tiers being adjustable in height hereby allowing the device to present more than one slope profile;

(b) first supporting columns, the height of the columns decreasing from the uppermost tiers towards the lowermost;

(c) second supporting columns, the height of the second columns decreasing from the uppermost tiers towards the lowermost, and being shorter than one of the first columns for the same tier;

(d) elevating motors to raise the level of the second columns from a lower inactive position of the second columns, corresponding to an active position of the first columns resting on the said floor and determining a first slope profile of the tiers, towards an active elevated position of the second columns supporting and raising the corresponding tiers, determining a second less accentuated slope profile, the first columns being then in an inactive position, wherein each tier comprises two of the said first columns both of the same height and integral with the said seat supporting platform and two of the said second columns, both of the same height and independent from the said platform and the said two second columns are connected together so as to form a unitary assembly.

2. The device of claim 1, wherein the said assembly formed by the two second columns connected together comprises overlap means allowing one overlapped assembly belonging to one tier to raise the adjacent overlapping assembly belonging to the uppermost tier under the action of the elevating motors.

3. The device of claim 1, wherein the first two columns integral with the corresponding platform are each slidably engaged freely within each of the two second columns of the same tier.

4. The device of claim 1, wherein it further comprises crosspieces connecting together all the second columns belonging to the same row of tiers, the second columns of all the tiers constitute a single unit raised by at least one elevating motor.

5. The device of claim 1, wherein the said second columns comprise individual adjustable lifting means for raising the corresponding tier so as to obtain a third slope profile of the tiers adjusted as a function of the specific needs.

6. The device of claim 1, wherein the second columns are in the form of pipes of flattened rectangular section and are connected by at least one upper beam to form the said second columns assembly, the long side of the second columns being longer than the width of the tiers mounted in overhang on the first columns, the two second columns belonging to a same said assembly being separated by a space decreasing from the uppermost tiers towards the lowermost, so as to allow telescopic engagement of the second column assemblies, said column assembly of a lower tier being engaged within the second columns assembly of an uppermost tier, allowing retraction and/or extension of the tiers, sliding over the floor, the columns being equipped with rolling means for allowing horizontal displacement thereof, and the second columns comprising guiding means placed on both opposite faces of two adjacent second columns belonging to two adjacent tiers, thus allowing reciprocal slide of the second columns belonging to one tier along the second columns of the adjacent tier, for said telescopic displacement of all of the tiers, the device comprising further driving means for horizontal displacement of the said second column assembly.

7. The device of claim 6, wherein said rolling means comprises wheels.

8. The device of claim 1, wherein the device further comprises safety barriers adapted to be placed successively in active and inactive position by the raising movement of said second columns.

* * * * *